US005572592A

United States Patent [19]

Muckelrath

[11] Patent Number: 5,572,592

[45] Date of Patent: Nov. 5, 1996

[54] REMOTE CONTROL AUDIO APPARATUS FOR HUNTERS

[76] Inventor: Bruce Muckelrath, Rte. 1, Box 284-C2, Sheridan, Ark. 72150

[21] Appl. No.: 452,885

[22] Filed: May 30, 1995

[51] Int. Cl.[6] ..... H04R 21/00

[52] U.S. Cl. ..... 381/56; 381/122; 381/124; 340/825.24; 340/825.27; 340/825.69; 340/825.72; 369/29; 369/7

[58] Field of Search ..... 381/56, 122, 124; 369/29, 7; 455/352, 353; 340/825.24, 825.27, 825.22, 825.25, 825.69, 825.72; 341/176

[56] References Cited

U.S. PATENT DOCUMENTS

| | | | |
|---|---|---|---|
| 4,050,186 | 9/1977 | Shults et al. . | |
| 4,517,564 | 5/1985 | Morishita | 340/825.69 |
| 4,549,179 | 10/1985 | Stendard . | |
| 4,612,001 | 9/1986 | Burnham . | |
| 4,760,547 | 7/1988 | Duxbury . | |
| 4,862,625 | 9/1989 | Dolan . | |
| 4,965,953 | 10/1990 | McKinney . | |
| 5,233,780 | 8/1993 | Overholt . | |
| 5,239,587 | 8/1993 | Muckelrath . | |

OTHER PUBLICATIONS

*Hunting*, p. 24, Feb. 1996.

Brochure, Ming Engineering & Product, Inc., RE–66 310 $MH_2$ AM RF Receiver.

Brochure, Ming Engineering & Products, Inc., TX–66 310 $MH_2$ AM SAW Super–Regenerative RE Transmitter.

*Primary Examiner*—Curtis Kuntz
*Assistant Examiner*—Minsun Oh
*Attorney, Agent, or Firm*—Ray F. Cox, Jr.

[57] ABSTRACT

A remote control audio apparatus for use by hunters having the capability of either recording or reproducing predator calls, game calls and the like. Audio reproduction and/or recording apparatus is disposed within a weather resistant enclosure. A radio transmitter and receiver is provided for generating, transmitting and receiving operating radio signals under manual control for remotely operating the audio apparatus. The radio remote control receiver is detachable from the audio apparatus. In one embodiment, a weather resistant external speaker may be stored within the weather resistant enclosure or detachably mounted to the exterior of the weather resistant enclosure.

3 Claims, 9 Drawing Sheets

| | |
|---|---|
| 3 | BATTERY PLUS (12 VDC) |
| 1 | REGULATED 6 VDC |
| 4 | REMOTE VOLUME POT HIGH SIDE |
| 2 | REMOTE VOLUME POT WIPER |
| 8 | REMOTE VOLUME POT GROUND SIDE |
| 7 | CIRCUIT GROUND |
| 6 | VOLUME CONTROL AND SWITCH LOCKOUT |
| 5 | BATTERY MINUS |

REMOTE CONTROL AUDIO APPARATUS FOR HUNTERS

BACKGROUND OF THE INVENTION

The present invention relates to an audio apparatus for use by hunters and, in particular, for an audio apparatus having the capability of either recording or reproducing predator calls, game calls and the like. The present invention further relates to an audio apparatus for use by hunters which may be operated by radio remote control using a detachable radio receiver mounted to the audio apparatus.

Hunters have adopted many devices which incorporate the principal of sound reproduction to attract game, predators or the like. The most commonly known sound reproduction devices are the mechanical calls employed by hunters to reproduce as nearly as possible the calls made by particular animals. Examples of these types of game calls are found in U.S. Pat. No. 4,612,001 and U.S. Pat. No. 4,050,186. Calls of this type, intended to attract predator or game animals, are basically hand held, mouth-blown devices which imitate the natural call of the animal.

A more sophisticated type of game call employs the same type of mechanical apparatus but introduces the additional feature of remote control. This allows the hunter to be stationed some distance from the source of the sound so as to reduce the potential for warning the animal away by the near presence of the hunter. An example of a remote control decoy is found in U.S. Pat. No. 4,965,953 issued to McKinney on Oct. 30, 1990 for "Remote Controlled Turkey Decoy." McKinney discloses a wild turkey decoy having a control line attached to head and neck members whereby a pull on the control line causes the decoy to simulate the motions of a feeding bird. While McKinney discloses remote control of a decoy apparatus, it does not disclose remotely controlling production of the sound of the game animal. A remote control game calling device is disclosed in U.S. Pat. No. 4,862,625 issued to Dolan on Sep. 5, 1989 for "Remotely Controlled Turkey Calling Device." Dolan discloses a trigger device which provides for a push-pull motion of a cable which activates a remotely located game calling device. Dolan is strictly a mechanical device relying on direct connection between the operator controlled trigger mechanism and the mechanical sound reproduction apparatus.

A more sophisticated remote control game calling apparatus is disclosed in U.S. Pat. No. 5,233,780 issued to Overholt on Aug. 10, 1993 for "Remotely Controlled Decoy and Method." Overholt discloses a turkey decoy having a mechanical type turkey call. The turkey call and the motion of the decoy are remotely controlled using a radio transmitter mechanically operated by the hunter which transmits radio signals to a receiver on the decoy to operate both the game call and the motion of the decoy.

All of the cited prior art employs mechanical type game calls. While hunting regulations may place certain limitations on the use of calls reproduced by an audio recording apparatus, such as a tape recorder, certain localities allow for the use of such sound reproduction under certain conditions. It is, therefore, desirable to provide for an audio recording and sound reproduction apparatus useful under the conditions encountered by hunters in the game woods. A sound recording device for use by hunters is disclosed in U.S. Pat. No. 5,239,587 issued to the inventor of the present invention. The previous invention provided for an audio recording apparatus disposed within a weather resistant case. The sound recording apparatus operated under timer control in order to sample selected time intervals in order to monitor sound (and therefore game) activity in a particular hunting area.

In addition to providing for an audio apparatus having sound recording and/or sound reproduction capabilities, it is desirable to provide for radio remote control so that the hunter may operate the apparatus from a distance so as not to disturb the predator or game animals by the near presence of the hunter. It is desirable to provide for a detachable radio receiver controlling the capabilities of the audio apparatus. A detachable radio receiver allows the option of manual operation of the audio apparatus. Furthermore, a detachable radio receiver may be employed on more than one device with the attendant savings in costs and with greater flexibility.

Detachable radio remote control receivers have been employed in unrelated arts but the inventor is unaware of the use of detachable radio remote control receivers on an audio apparatus adapted for use by hunters. For example, U.S. Pat. No. 4,549,179 issued to Stendardo on Oct. 22, 1985 discloses a radio remote control unit for use on home electronic equipment possessing an audio output. Stendardo's radio remote control receiver unit includes its own speaker which replaces the disabled internal speaker of the equipment to be controlled. A hand-held remote control transmitter is used to control the volume of the speaker in the remote control receiver unit.

Another such detachable radio remote control receiver is disclosed in U.S. Pat. No. 4,760,547 issued to Duxbury on Jul. 26, 1988. Duxbury discloses an irrigation remote control system.

SUMMARY OF THE INVENTION

In the present invention an audio apparatus having means for recording and/or reproducing predator calls, game calls and the like is disposed within a weather resistant case so that the apparatus may be deployed by a hunter for either recording the sound of animals in their natural environment or for reproducing predator calls, game calls and the like. Both recording and reproduction capabilities may be present in a given embodiment of the present invention or only recording or reproduction may be required in a particular application.

The present invention further provides for remote control of the audio apparatus through a remote radio transmitter operated by the hunter and communicating with a radio receiver to control the operation of the audio apparatus.

The present invention further provides for detachability of the radio remote control receiver.

Further objects and advantages of the present invention may best be understood by reference to the following detailed description of the preferred embodiments in connection with the accompanying drawings.

DETAILED DESCRIPTION OF THE PREFERRED EMBODIMENTS

Figure 1:
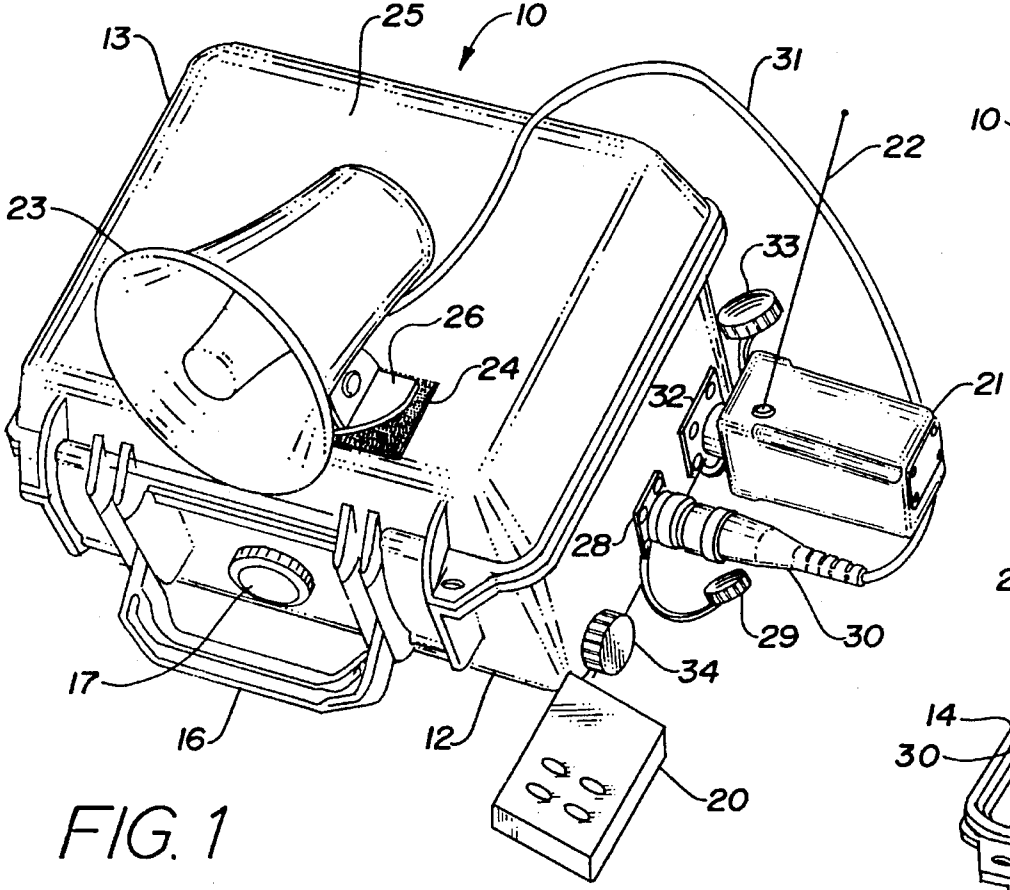
FIG. 1 is a perspective view of the present invention as deployed for operation with the detachable radio remote control receiver in position and the external speaker disposed on the exterior surface of the weather resistant enclosure.

The major components of the present invention may be described with reference to FIGS. 1 and 2. A weather resistant case 10 is provided to house a cassette recorder 11 which provides either recording or playback of audio information. The weather resistant case 10 includes a bottom section 12 and a lid 13. The bottom section 12 and the lid 13 are each of molded one piece construction so as to present a continuous barrier to moisture infiltration into the interior of the case 10. A seal 14 between the bottom section 12 and the lid 13 provide for additional security against the entry of moisture and thus render the entire case 10 weather resistant when closed as shown in FIG. 1. The lid 13 is latched closed by means of latches 15 and since it is intended to be portable, it is provided with a handle 16. Since the case 10 is tightly sealed, changes in pressure inside and outside the case 10 can result in a lower air pressure inside the closed case 10 relative to the exterior atmosphere. As a result, a pressure relief valve 17 may be actuated to allow air into the interior of the case 10 so as to allow for opening of the lid 13.

For storage or transportation various components may be stowed within the case 10. FIG. 2 shows the radio transmitter 20 and the detachable radio receiver 21 stowed within the lid 13. The radio transmitter 20 and the radio receiver 21 may be attached to the lid 13 by means of hook and loop type fasteners of the velcro type or similar means. The radio receiver 21 is provided with an antenna 22. Sufficient space is provided within the lid 13 for stowing the antenna 22 with a minimal degree of bending.

The case 10 further provides storage space in the bottom section 12 for the external speaker 23. The external speaker 23 may be attached to the bottom section 12 using velcro type fasteners as described above with reference to the radio transmitter 20 and radio receiver 21. However, since the external speaker 23 is a rather heavy and bulky object, the preferred fastener is the dual-lock material manufactured by 3M. The dual-lock material is also preferred for attaching the external speaker 23 to the exterior of the case 10 as shown on FIG. 1. A dual-lock pad 24 is affixed to the top surface 25 of the lid 13. A complementary portion of dual-lock material is fastened to the base 26 of the external speaker 23. The external speaker 23 is thus removably attached to the exterior of the case 10 and may be removed for storage as shown in FIG. 2.

FIG. 1 shows the present invention as deployed for use. As noted above, the external speaker 23 is attached to the top surface 25 of the lid 13. The lid 13 is firmly closed so as to render the interior of the case 10 weather tight thereby protecting the cassette recorder 11 and additional circuitry located within the case 10 as will be described more completely hereafter. On the exterior 27 of the bottom portion 12, a 4-pin electrical connector 28 is disposed with a screw-on, waterproof cap 29. The 4-pin connector 28 is electrically connected to the circuitry in the interior of the case 10 and provides a point of connection for the speaker plug 30 which is electrically connected via a cable 31 to the external speaker 23.

Also disposed on the exterior 27 of the bottom portion 12 is an 8-pin connector 32 having a screw-on, waterproof cap 33. The 8-pin connector 32 is electrically connected to the circuitry in the interior of the case 10 and provides a point of connection for the detachable radio remote control receiver 21.

The exterior 27 of the bottom portion 12 also contains a volume control knob 34 which is electrically connected to the circuitry located in the interior of the case 10 for manual control when the radio remote control receiver 21 is not in use.

Figure 2:
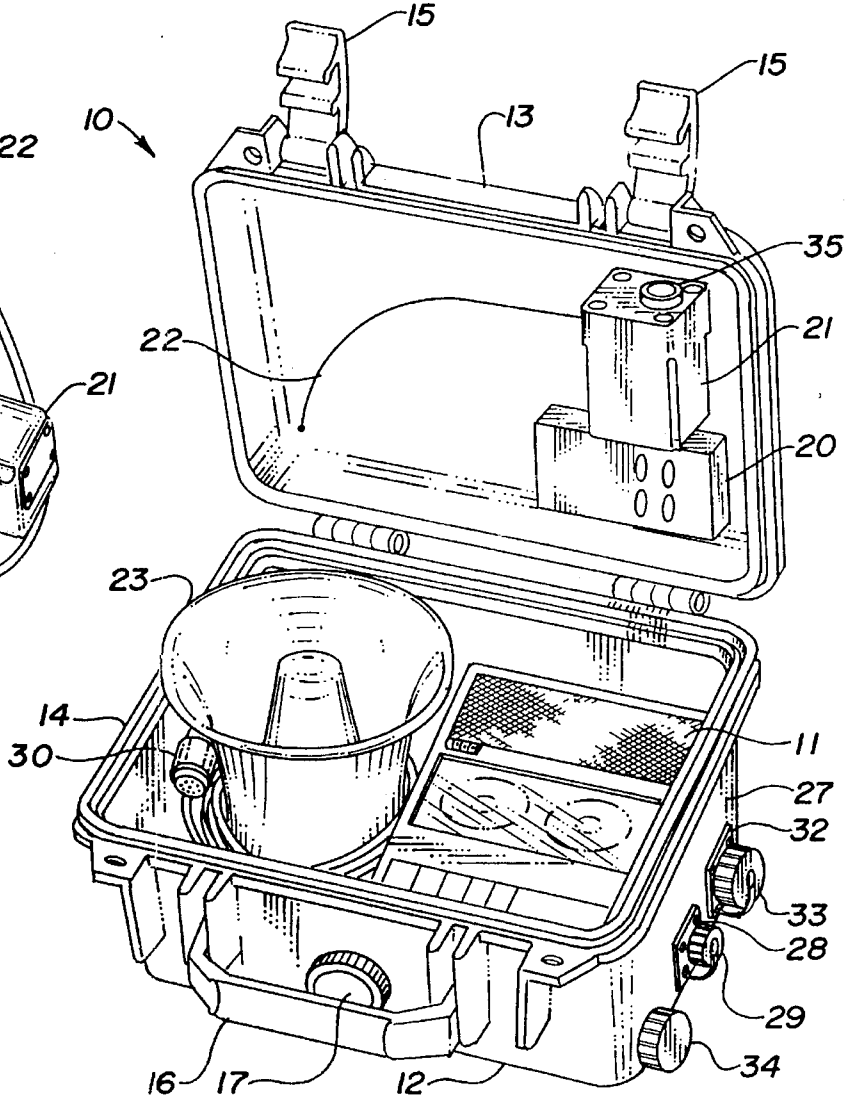
FIG. 2 is a perspective view of the present invention with the weather resistant enclosure open to show the radio transmitter, detachable remote control receiver and external speaker in the stored position.

In order to convert the apparatus from the stored configuration shown in FIG. 2 to the operational configuration shown in FIG. 1, the latches 15 are released and the lid 13 raised to provide access to the interior of the case 10. The external speaker 23 is removed from the interior of the case 10 and by means of the dual-lock connectors disposed on the exterior surface 25 of the lid 13. The screw-on cap 29 of the 4-pin connector 28 is removed and the speaker plug 30 is plugged into the 4-pin connector 28. The screw-on cap 33 of the 8-pin connector 32 is removed. The detachable radio remote control receiver 21 is removed from the lid 13 and plugged into the 8-pin connector 32 by means of an 8-pin plug 35 which is electrically connected to the circuitry of the radio remote control receiver 21 as will be described more completely hereafter. The radio remote control transmitter is removed and retained by the user. The lid 13 is then placed in position against the seal 14 and the latch is operated to provide a complete weather resistant enclosure. The apparatus may then be placed in position by the hunter as appropriate. The hunter then retires to a distance from the apparatus. The hunter may then manually operate the radio remote control transmitter 20 so as to send signals to the remote control receiver 21. The remote control receiver 21 then transmits electrical signals to the interior circuitry of the case 10 in a manner that will be more completely described hereinafter so as to operate the cassette recorder 11. The output of the cassette recorder 11 is electrically connected to the external speaker 23 for reproduction of those sounds that have been recorded on the cassette recorder. The cassette recorder 11 may contain a tape having selected predator calls, game calls or the like. The radio remote control transmitter 20 may be used to turn the cassette recorder on and off and to adjust volume up and down.

In an alternative embodiment of the present invention, the external speaker 23 may be replaced or supplemented by an external microphone. When the cassette recorder is in the record mode the apparatus may be used to record sounds in the vicinity of the apparatus as opposed to reproducing sounds. In either embodiment, the apparatus may be operated manually as well as by means of the radio remote control receiver.

In addition, the radio remote control receiver 21 may be detached from one unit and used on another unit. It is thus possible to use a single remote control receiver in conjunction with more than one unit. This may be desirable for reasons of economy. Furthermore, the radio transmitter 20 may be programmed to activate more than one remote control receiver. The apparatus, therefore, may be used flexibly in a number of operational configurations.

Figures 3, 6B:
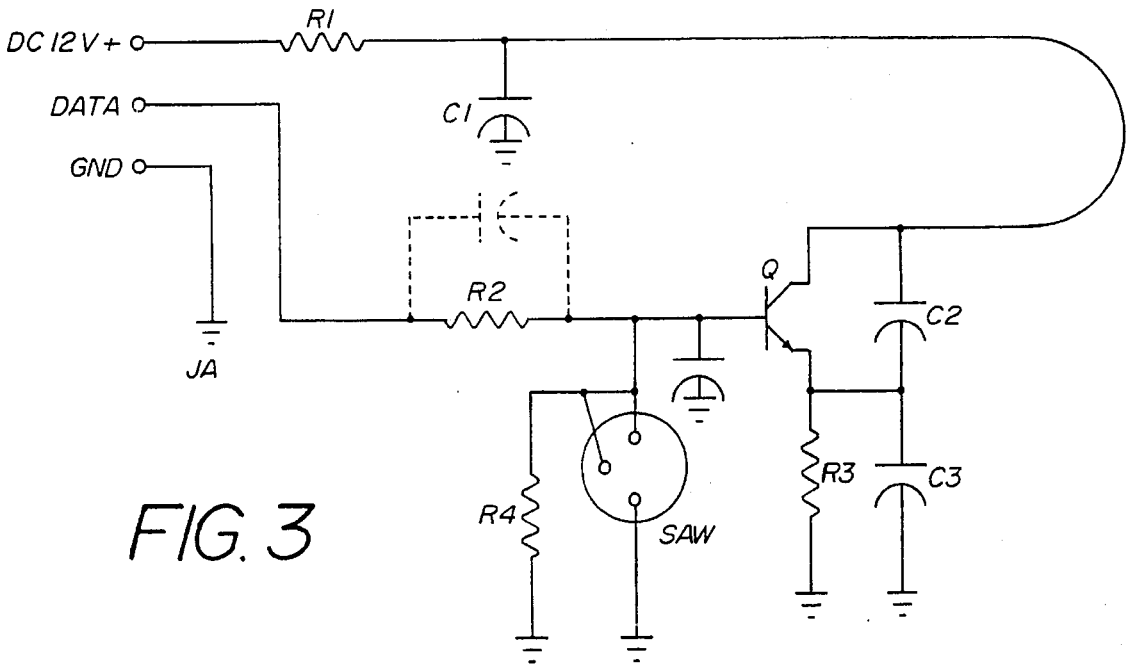
FIG. 3 Prior Art
FIG. 3 is an electrical schematic of the TX-66 radio receiver.
Figure 4:
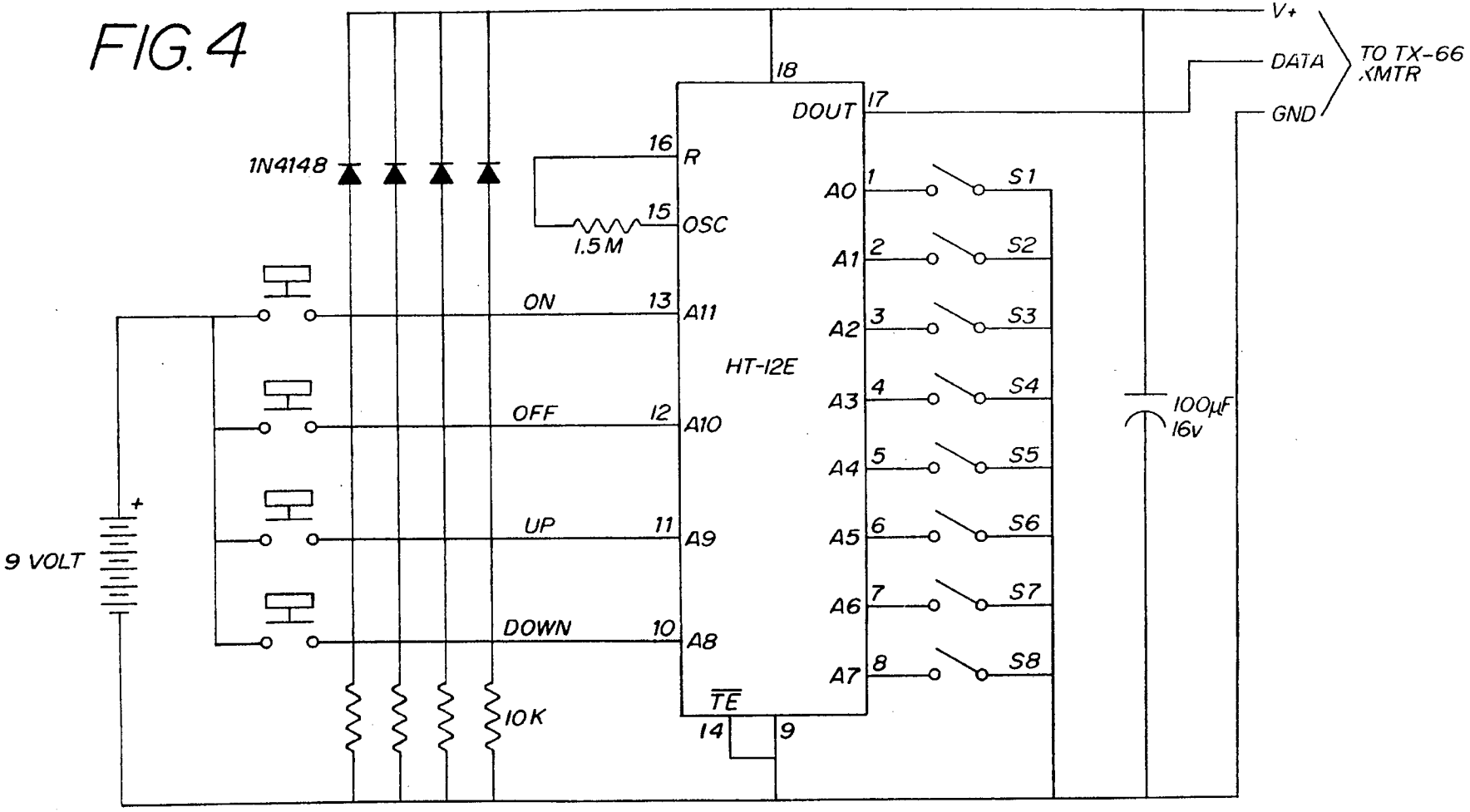
FIG. 4 is an electrical schematic of the interface circuitry for the TX-66 radio transmitter.
Figure 5:
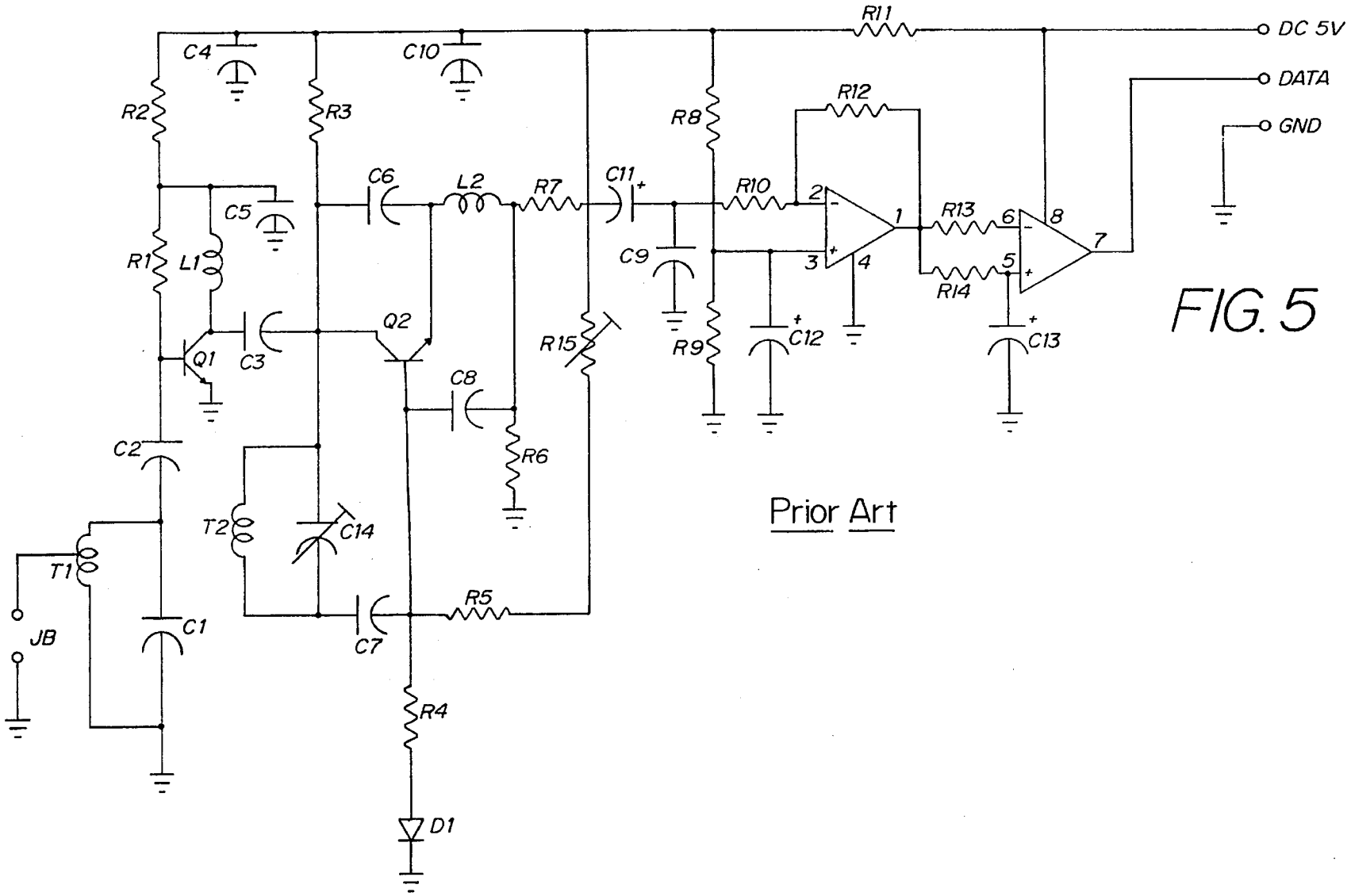
FIG. 5 Prior Art
FIG. 5 is an electrical schematic of the circuitry of the RE-66 radio receiver.
Figure 6A:
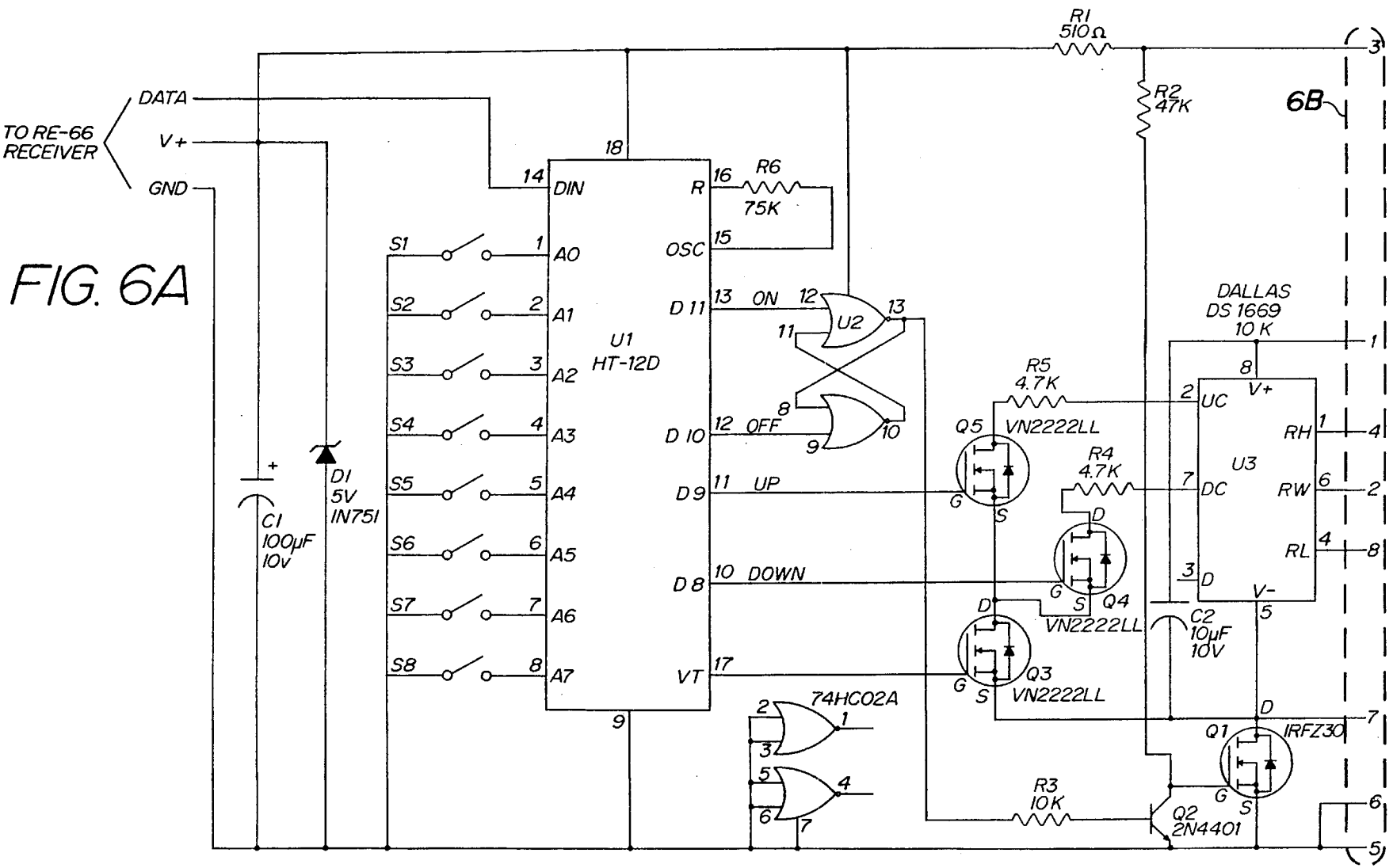
FIGS. 6 is electrical schematics of the interface circuitry for the RE-66 receiver.
Figure 7A:
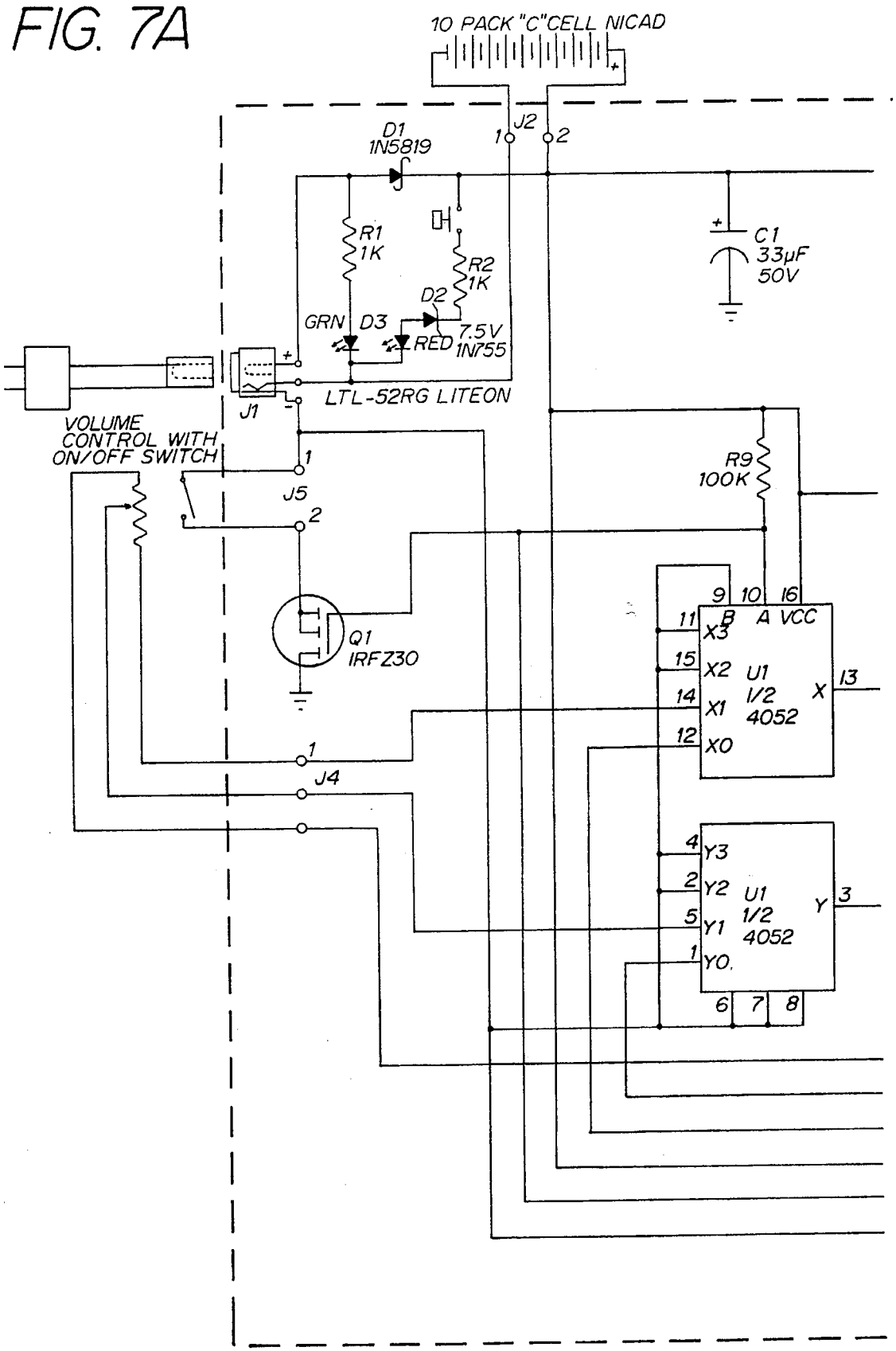
FIGS. 7 is electrical schematics of the control circuitry.
Figure 7B:
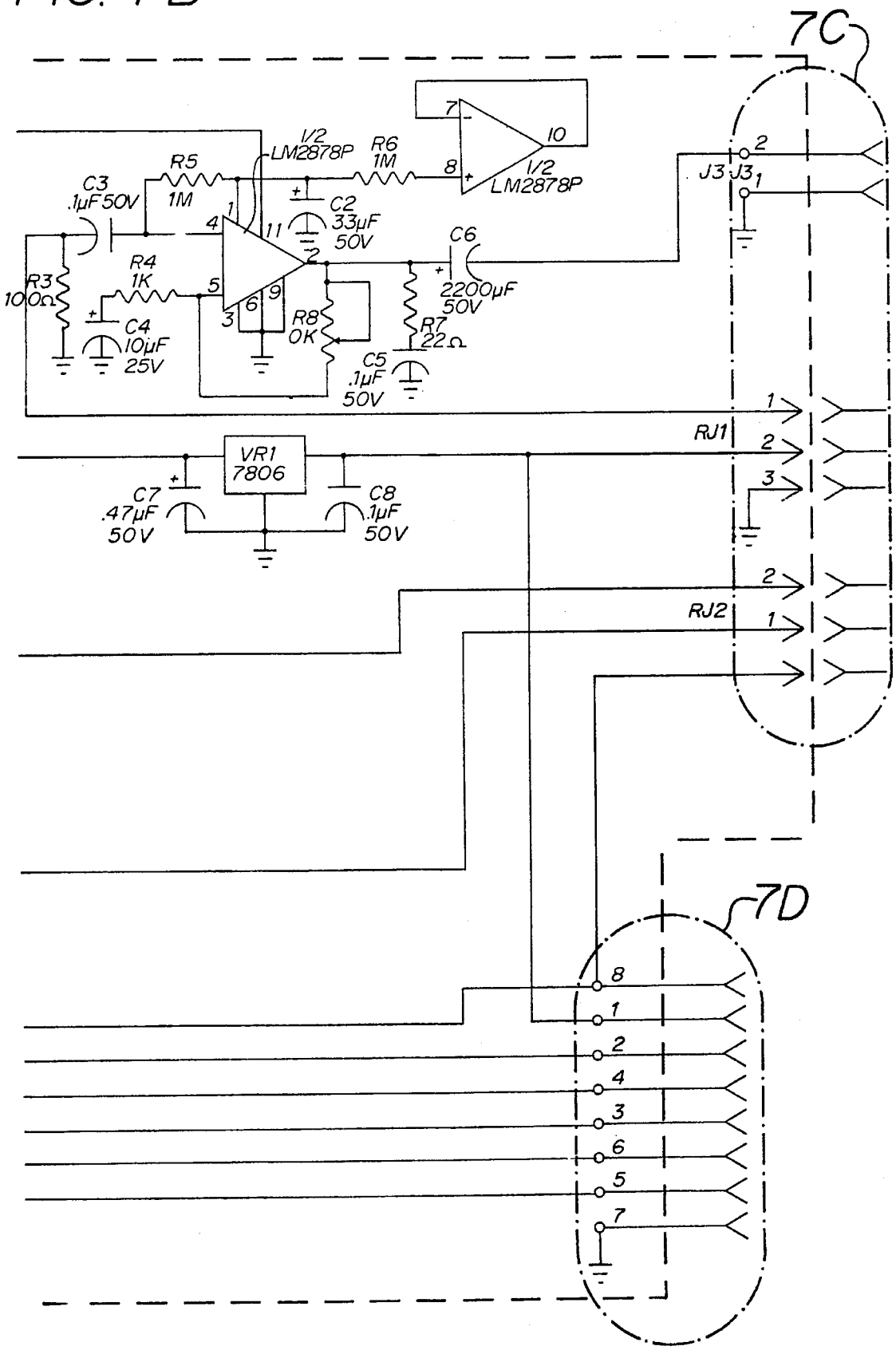
Figure 7C:
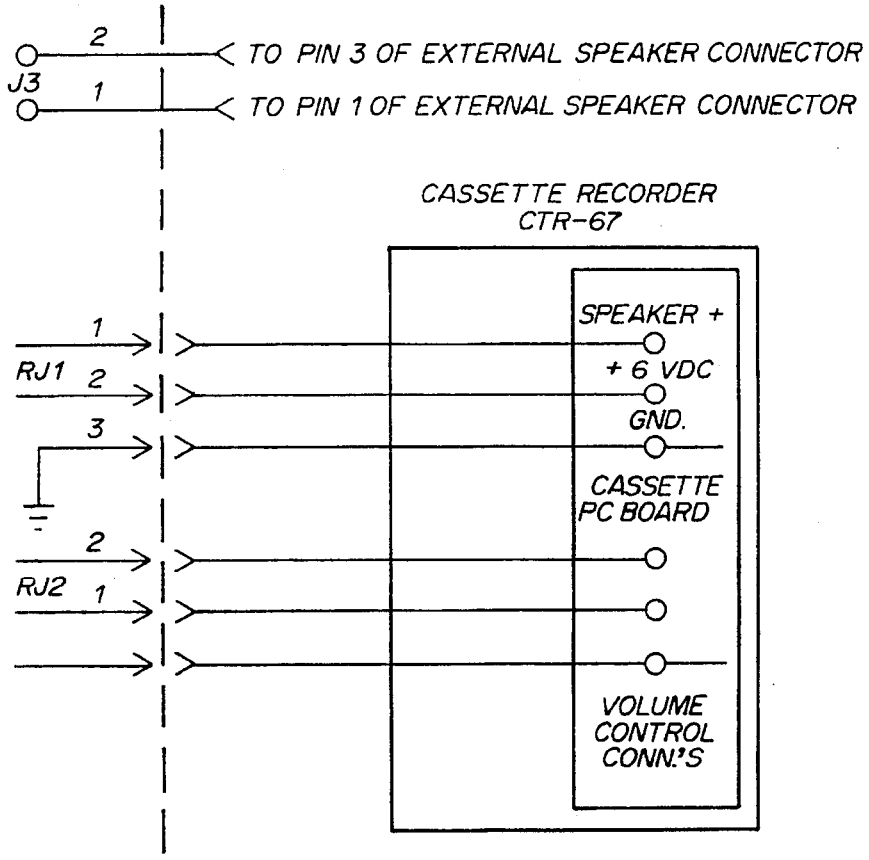
Figure 7D:
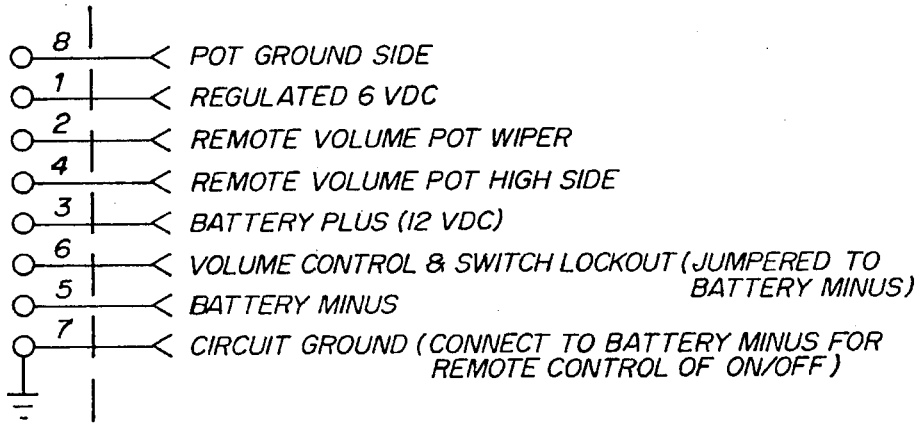
Figure 8:
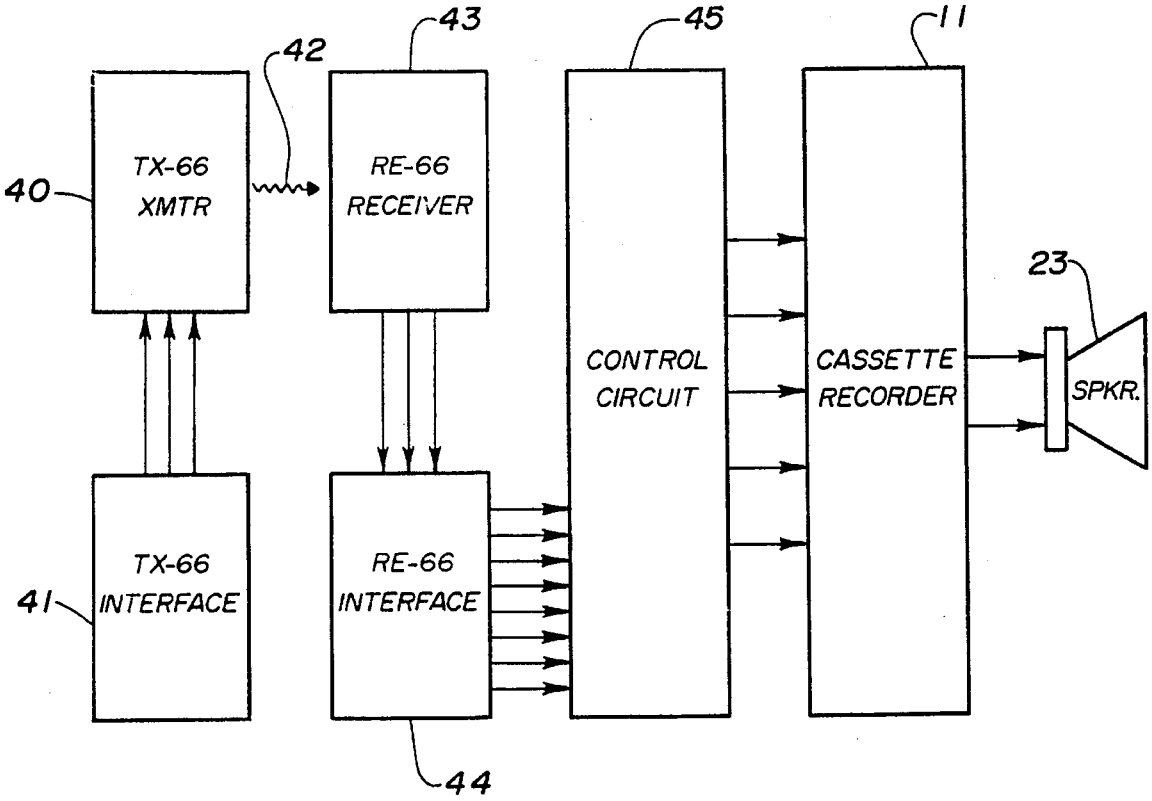
FIG. 8 is a block diagram of the interconnections among the electrical components.

The electronic circuitry of the present invention may be described generally with reference to FIG. 8. The radio transmitter 20 has been found to operate successfully based around a radio transmitter circuit available from Ming Engineering and Products, Inc., 17921 Rowland Street, City of Industry, Calif. 91748, known as the TX-66. The TX-66 is a 310 megahertz AM super-regenerative transmitter. The TX-66 accepts serial data sent from an encoder and transmits it to the receiver. The circuitry of the TX-66 transmitter 40 is described in FIG. 3. The encoding of the serial data transmitted to the TX-66 transmitter 40 is by means of the TX-66 interface circuitry 41 shown in FIG. 4. By manual operation of the switches, serial data is generated by HT-12E chip for transmission to the TX-66 transmitter 40. The TX-66 transmitter generates the radio signals 42 which are received by the antenna 22 of the radio remote control receiver 21. The radio remote control receiver 21 comprises a receiver circuit based on the RE-66 receiver 43 manufactured by Ming Engineering and Products, Inc. The RE-66 receiver 43 is designed to receive serial data from the TX-66 transmitter 40. The serial data received by the RE-66 receiver is decoded by the RE-66 interface 44. The detailed circuitry of the RE-66 receiver 43 is shown in FIG. 5. The RE-66 interface 44 is shown in FIGS. 6*a* and 6*b*. The serial data decoded by the RE-66 interface 44 is transmitted to the control circuitry 45 which is physically situated in the interior of the case 10. The control circuitry is shown in detail in FIGS. 7*a* through 7*d*. The serial data received by the receiver 43 is supplied to the control circuitry 45 for decoding so as to produce control signals for the cassette recorder 11. The output of the control circuitry 45 is transmitted to the cassette recorder 11 in order to control the functions of the cassette recorder. While the receiver and transmitter circuits have been described in terms of the particular circuitry available from Ming Engineering and Products, Inc., the scope of the present invention is not so limited. The prior art provides various forms of radio transmission, reception, and remote control circuitry which could be employed in the present invention as would be readily understood by one skilled in the art.

The present invention has been described with reference to certain preferred and alternative embodiments which are intended to be exemplary only and not limiting to the full scope of the present invention as embodied in the appended claims.

What is claimed is:

1. A remote control audio apparatus for hunters, comprising:

a weather resistant enclosure having an exterior surface and an interior space;

audio means disposed within said interior space for reproduction and/or recording of predator calls, game calls and the like;

radio transmitter means for generating and transmitting operating radio signals under manual control;

radio receiver means for receiving said operating radio signals and generating electronic output signals responsive thereto;

control means disposed within said interior space and electronically communicating with said audio means and said radio receiver means, said control means being adapted to receiving said electronic output signals and to controlling operation of said audio means in response to said electronic output signal; and an electronic plug connector disposed on said exterior surface and communicating electronically with said control means; and said radio receiver means further comprising a plug for detachable electronic connection to said plug connector whereby said electronic output signals are communicated to said control means.

2. The apparatus of claim 1, further comprising an external weather resistant speaker having a speaker plug means for detachably mounting said external speaker to said exterior surface, and a speaker plug connector disposed on said exterior surface and communicating electronically with said audio means whereby said speaker plug may be electronically connected to said audio means.

3. The apparatus of claim 2 further comprising storage means for removably storing said external speaker in said interior space.

* * * * *